United States Patent [19]

Fraioli

[11] Patent Number: 4,478,012

[45] Date of Patent: Oct. 23, 1984

[54] CABLING SYSTEM FOR AN INFLATABLE BUILDING

[75] Inventor: Donato M. Fraioli, Mamaroneck, N.Y.

[73] Assignee: Air Structures International, Inc., Tappan, N.Y.

[21] Appl. No.: 420,105

[22] Filed: Sep. 20, 1982

[51] Int. Cl.[3] ..... E04B 1/34

[52] U.S. Cl. ..... 52/2; 52/83; 135/102

[58] Field of Search ..... 52/2, 83, 247, 245; 474/151, 144; 135/102

[56] References Cited

U.S. PATENT DOCUMENTS

| | | | |
|---|---|---|---|
| 3,382,625 | 5/1968 | Kuss | 52/223 R |
| 3,744,191 | 7/1973 | Bird | 52/2 |
| 3,885,360 | 5/1975 | Fraioli | 52/2 |
| 4,186,530 | 2/1980 | Fraioli | 52/2 |

FOREIGN PATENT DOCUMENTS

| | | | |
|---|---|---|---|
| 214190 | 12/1956 | Australia | 52/83 |
| 588322 | 1/1978 | U.S.S.R. | 52/83 |
| 652289 | 3/1979 | U.S.S.R. | 52/83 |

*Primary Examiner*—Henry E. Raduazo
*Attorney, Agent, or Firm*—Curtis Ailes

[57] ABSTRACT

The cabling system comprises a latticework of criss-crossed cables with the cables which meet at a lower peripheral edge of the structure at opposite diagonal angles being formed from one continuous cable with an anchoring means comprising a sheave to permit adjustment in the length between the associated diagonal cables in response to unequal stresses.

10 Claims, 7 Drawing Figures

CABLING SYSTEM FOR AN INFLATABLE BUILDING

This invention relates to building structures which usually consist basically of textile fabric, and which are maintained in an erect condition by an air blower which inflates the building structure and maintains the inflation. The present invention relates particularly to an improved system of cables for reinforcement of such an inflatable building.

BACKGROUND OF THE INVENTION

It has been found that when inflatable buildings are constructed in an appreciable size, the textile walls of the building are advantageously reinforced by a network of cables which is arranged around the exterior of the building.

The functions of the cabling system are basically to resist the loading upon the building occasioned by the inflation pressure from inside the building and the loading caused by wind upon the building.

In order to withstand wind forces, the building must be capable of some deformation and movement in response to the wind, accompanied by varying stresses upon the cabling system.

Accordingly, it is one important object of the present invention to provide an improved cabling system for an inflatable building in which the stresses, particularly the stresses of wind loading, are more effectively handled.

Another problem involved with the stresses on cabling systems for inflatable buildings is the problem of localized stresses, particularly at the ground anchors for the building, which are sometimes referred to also as base attachments.

Accordingly, another important object of the present invention is to provide an improved cabling system for an inflatable building in which localized stresses on the ground anchors are minimized.

SUMMARY OF THE INVENTION

In carrying out the invention there is provided a cabling system for reinforcement of an inflatable building structure comprising a latticework of crisscrossed cables arranged to extend over the entire building with substantially all of the cables which meet a lower peripheral edge of the structure being arranged diagonally at a uniform angle of substantially less than ninety degrees to that edge and with substantially all of said cables which meet a lower peripheral edge being paired with and meeting an opposite diagonally extending cable at said peripheral edge, the members of each of said pairs of diagonally opposite extending cables being formed from one continuous cable extending down on one diagonal to the edge and turning back up on the other diagonal, anchoring means to hold said continuous cable at the turn between diagonals, said anchoring means comprising a sheave arranged to permit an adjustment in length between the associated diagonal cables wherein one diagonal cable becomes longer and the other diagonal cable becomes shorter.

DETAILED DISCLOSURE OF PREFERRED EMBODIMENTS

Figure 1:
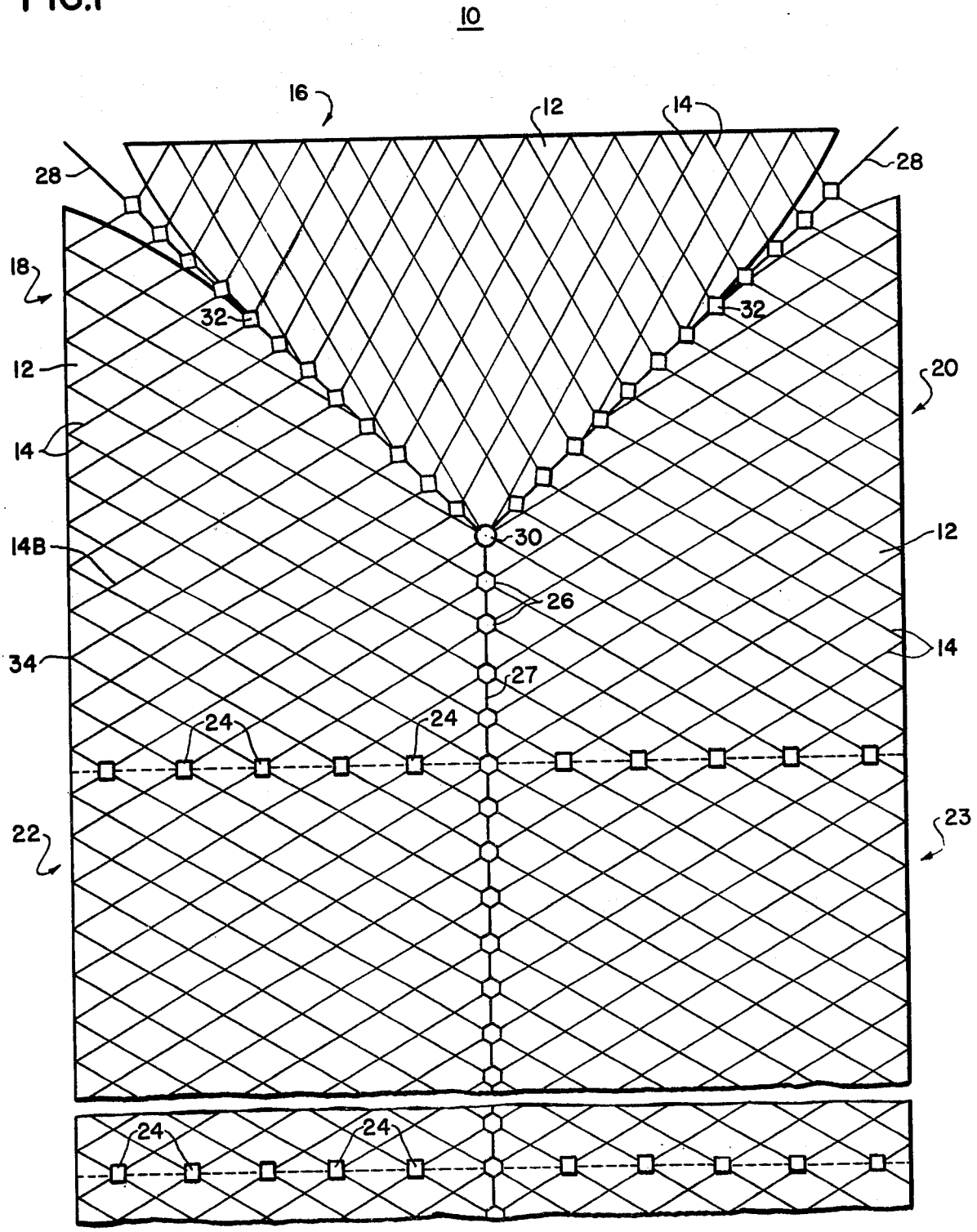
FIG. 1 is a partial plan view of a partially assembled inflatable building structure incorporating the reinforcement cabling system of the present invention, and illustrating how the building is sectionalized.

FIG. 1 is a partial plan view of an inflatable building structure incorporating the cabling system of the present invention prior to inflation. The building is designated as a whole as 10, and includes a fabric shell 12 and a latticework of crisscrossed cables 14. The edges of the structure are to be anchored to the ground, and the base outline may be rectangular, as shown.

The portion of the building illustrated is one end of the building, which includes a generally triangular end panel 16, and corner panel sections 18 and 20. Just below the panels 18 and 20 in the drawing there are illustrated rectangular side panels 22 and 23. Beyond the side panels 22 and 23, the other end of the building is terminated with additional corner panels corresponding to panels 18 and 20, and an additional end panel corresponding to panel 16. Since those corner panels and the end panel are simply mirror images of the panels illustrated, they are not shown in this drawing. If the building is to be quite short, the rectangular side panel sections 22 and 23 may be omitted. On the other hand, if the building is to be longer, additional rectangular side panels 22 and 23 may be inserted. It is for ease in shipment and assembly that both the fabric wall of the building structure and the cabling system are preferably constructed in section panels which are joined together at the edges.

The joints between the cables of the cabling system at the edges of the section panels are carried out by means of cable connector clamps, such as those indicated in FIGS. 5 through 7, and to be described more fully below. These clamps are sometimes referred to as "sectionalizing" cable clamps. Where four cable ends are to be connected together, such as is generally the case for the cable connectors indicated in FIG. 1 at 24, the cable connector clamp of FIG. 5 may be employed. Where six cable ends are to be connected together, such as is the case for the cable connectors indicated at FIG. 1 at 26, the cable connector clamp of FIG. 6 may be employed. Two of the connections to each of the cable clamps 26 accomodate for short sections of a ridge cable 27, each short section extending from one clamp 26 to the next adjacent clamp 26.

At the corners of the structure it has been found to be advantageous to provide, as a part of the cabling system, a corner cable, such as indicated at 28, which runs diagonally along the corner and up to the intersection of the peak of the triangular end section 16 and the mutual edges of the section panels 18 and 20, at a cable connector clamp 30. The corner cable 28 is preferably formed of short cable sections extending only between adjacent clamps 32. These clamps also attach the cable ends which terminate at the corner cable 28. The clamp of FIG. 5 may be used.

Figure 7:
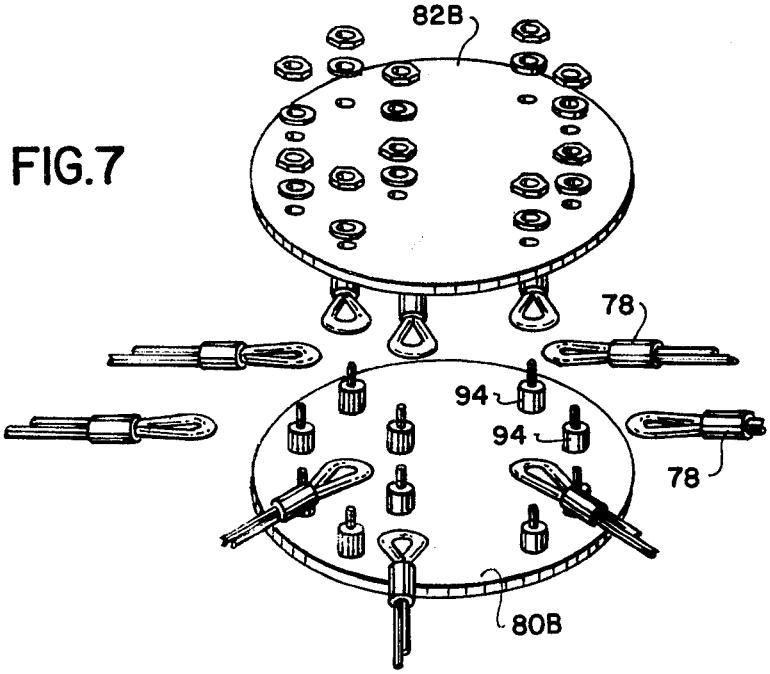
FIG. 7 illustrates another cable connector clamp which is capable of interconnecting up to ten cable ends.

At clamp 30 at the top of the end panel 16, a large number of cable ends must be connected together, and for this purpose a cable connector clamp such as illustrated in FIG. 7 may be employed.

It is one of the preferred features of the present invention that each of the individual cables 14 is oriented at an angle which is substantially less than ninety degrees to the edge of the structure. Thus, as illustrated in FIG. 1, the cables are each arranged at a uniform angle with respect to the adjacent outer edge of the structure which is substantially less than ninety degrees to that edge. The preferred angle is about sixty degrees, as illustrated in FIG. 1.

Within each section of the cabling system, at each crossing of cables, there is preferably provided a permanent cable clamp in order to maintain the shape of the cable lattice during inflation, and in order to contribute to the strength of the structure. Thus, at every point of cable crossing within a section of the building, such as at an intersection 15, a permanent clamp is provided. A preferred clamping device for this purpose is disclosed in a co-pending patent application entitled CABLE TIE FOR AN AIR SUPPORTED STRUCTURE CABLE NET, Ser. No. 413,266 filed on Aug. 31, 1982 by Carmine Carpanzano, and assigned to the same assignee as the present application.

As illustrated in FIG. 1, all of the cables 14, which meet at a lower peripheral edge, are paired with, and meet, an opposite diagonally extending cable at the peripheral edge. Attention is directed for instance to cable 14A, and cable 14A which are paired together, and meet at the peripheral edge at point 34. The cables 14A and 14B are formed from one continuous cable which extends down on one diagonal 14A to the edge at 34 and turns back up on the other diagonal 14B. An anchoring means is provided at 34 to hold the continuous cable at the turn between diagonals. The anchoring means consists of a sheave arranged to permit an adjustment in length between the associated diagonal cables 14A and 14B so that one diagonal cable can become longer and the other diagonal cable can become shorter in response to stresses upon the structure.

Figure 2:
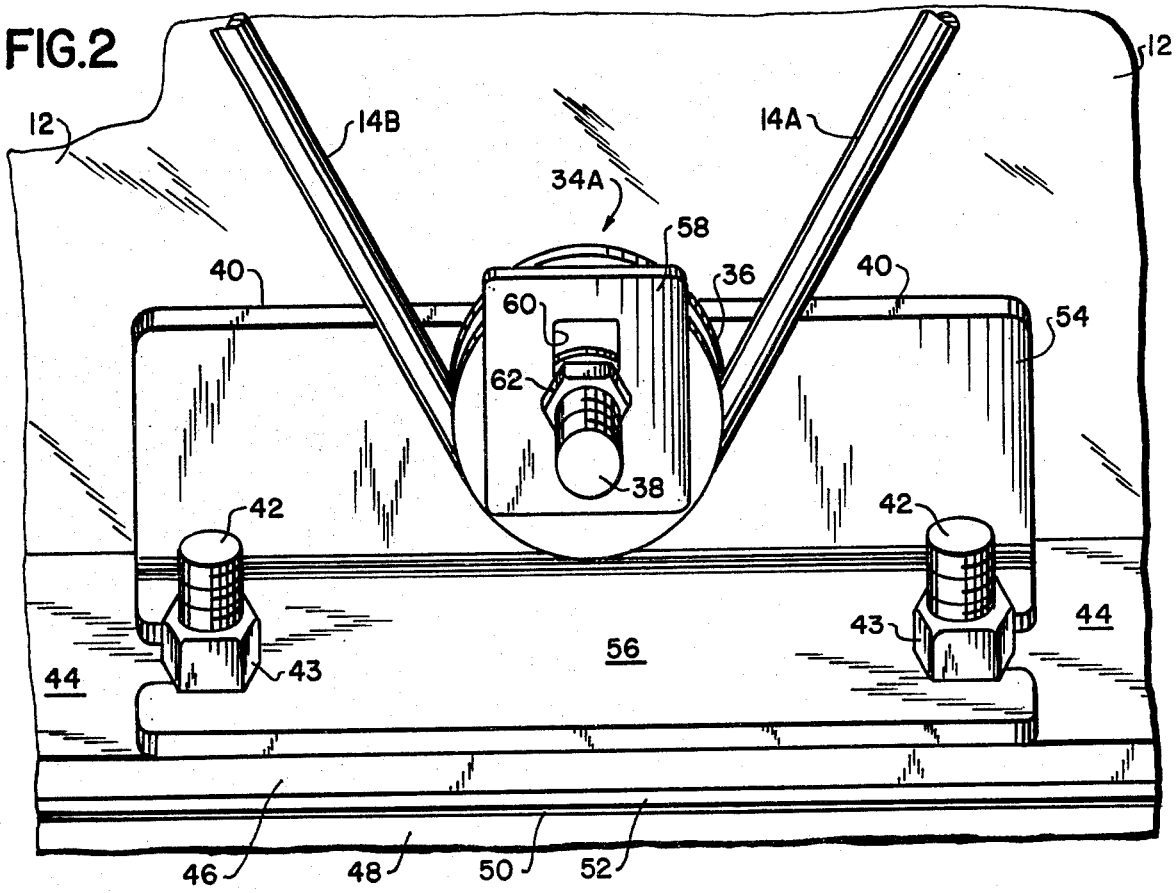
FIGS. 2 and 3 illustrate a preferred anchoring means used at the bottom edges of the cabling system, FIG. 2 showing a cable locking plate in the raised (unlocked) position, and FIG. 3 showing the locking plate in the lowered (locked) position.
Figure 3:
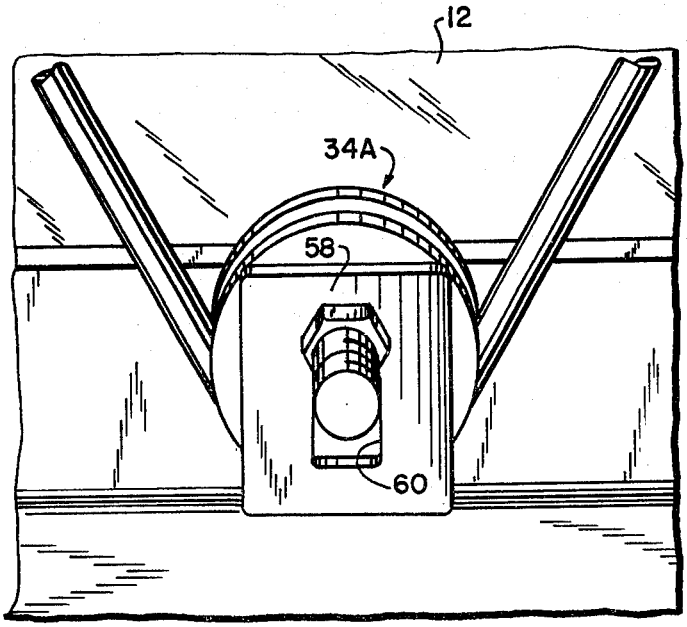

FIGS. 2 and 3 illustrate a preferred form of the anchoring means at point 34 in FIG. 1. The anchoring means is designated as a whole in each of the FIGS. 2 and 3 as 34A, and includes a sheave 36 mounted upon a shaft post 38 which is supported by an L-section support bracket 40, which is anchored by means of studs 42 to a base structure 44. The base structure may preferably include a steel clamping strip 46 and a concrete footing 48. The clamping strip 46 clamps the edge 50 of the fabric of the inflatable structure to the footing 48 together with a resilient gasket 52 to provide an airtight seal. The studs 42 are embedded in the concrete footing 48, and serve not only to attach the bracket 40, but also to assist in the attachment of the sealing strip 46 to the footing 48. As illustrated in FIGS. 2 and 3, the sheave axle 38 is attached to the upstanding leg 54 of the bracket 40, and the other leg 56 of bracket 40 is arranged to be attached to the base structure 44. The axle 38 is substantially perpendicular to a plane defined by the cables 14A and 14B, and the associated latticework of cables in the vicinity of the sheave 36 when the building is inflated.

For retention of the loop of cable formed by 14A and 14B upon the pulley sheave 36, there is preferably provided a locking plate 58, which is illustrated in the raised position in FIG. 2, and in the lowered (locked) position in FIG. 3. The locking plate 58 has a slotted center opening at 60 to permit it to be raised and lowered upon the axle 38 when the threaded hex-nut 62 is loosened. After the cable 14A–14B is inserted in the sheave, and the locking plate 58 is lowered into the locked position, the nut 62 is tightened to retain the locking plate 58 in the locked position.

While not illustrated in the drawing, the part of the axle 38 on which the sheave 36 rotates is preferably of substantially larger diameter than the threaded outer portion engaged by the nut 62, and forms a shoulder against which the nut 62 may lock the locking plate 58, without impairing the rotatability of the sheave 36.

The sheave 36 is preferably freely rotatable so as to permit ease of adjustment of the lengths of the cables 14A and 14B, and equalization of the stresses between those two cables. However, friction may be added to the rotation of sheave 36, if desired, and the sheave 36 may actually be made non-rotatable, without departing from the scope of the present invention.

In order to prevent undue bending of the cable 14A–14B at the sheave 36, the working diameter of the sheave, at the cable groove, is preferably at least in the neighborhood of nine times the diameter of the cable. This diameter is sufficient to prevent undue stress in the cable and risk of breakage.

Figure 4:
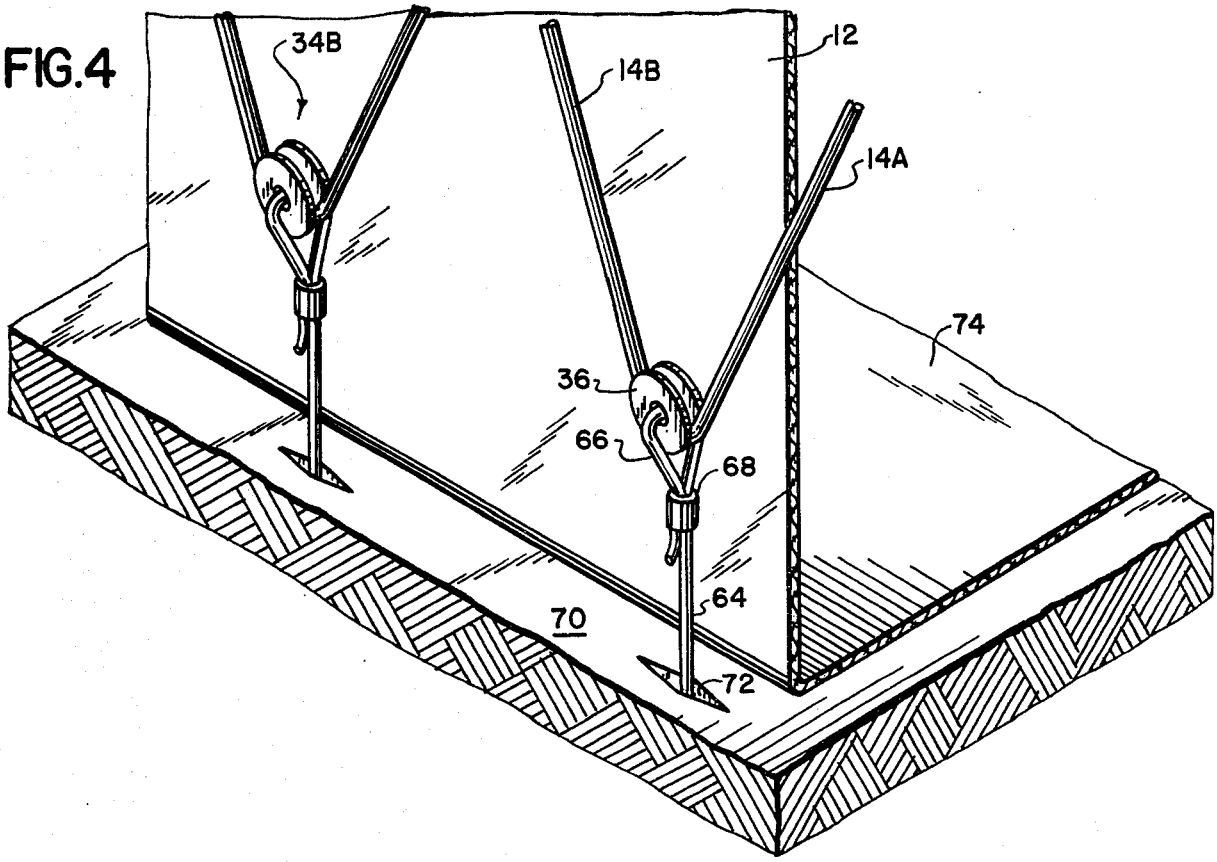
FIG. 4 illustrates an alternative arrangement for the anchoring means of FIGS. 2 and 3.

FIG. 4 is a perspective view illustrating an anchoring arrangement which is an alternative to that illustrated in FIGS. 2 and 3. The FIG. 4 embodiment is for use with air supported structures which are erected without having a permanent concrete footing or anchoring pad. In FIG. 4, each sheave pulley 34B is held by an anchoring cable 64 which is provided with an end loop 66 threaded through the center of the sheave 36, and securely clamped to the body of the cable at 68. Alternatively, a conventional pulley block containing a single sheave may be similarly attached to the cable 64. The anchoring cable 64 may be held to the ground 70 by a conventional anchoring device driven into the ground, as indicated at the slotted opening 72. In such a structure, the fabric body of the air supported structure is simply folded in at the base of the structure, as indicated at 74, to make a seal with the ground.

The cable connector clamps of FIGS. 5 through 8 have been briefly referred to above in connection with the description of FIG. 1.

Figure 5:
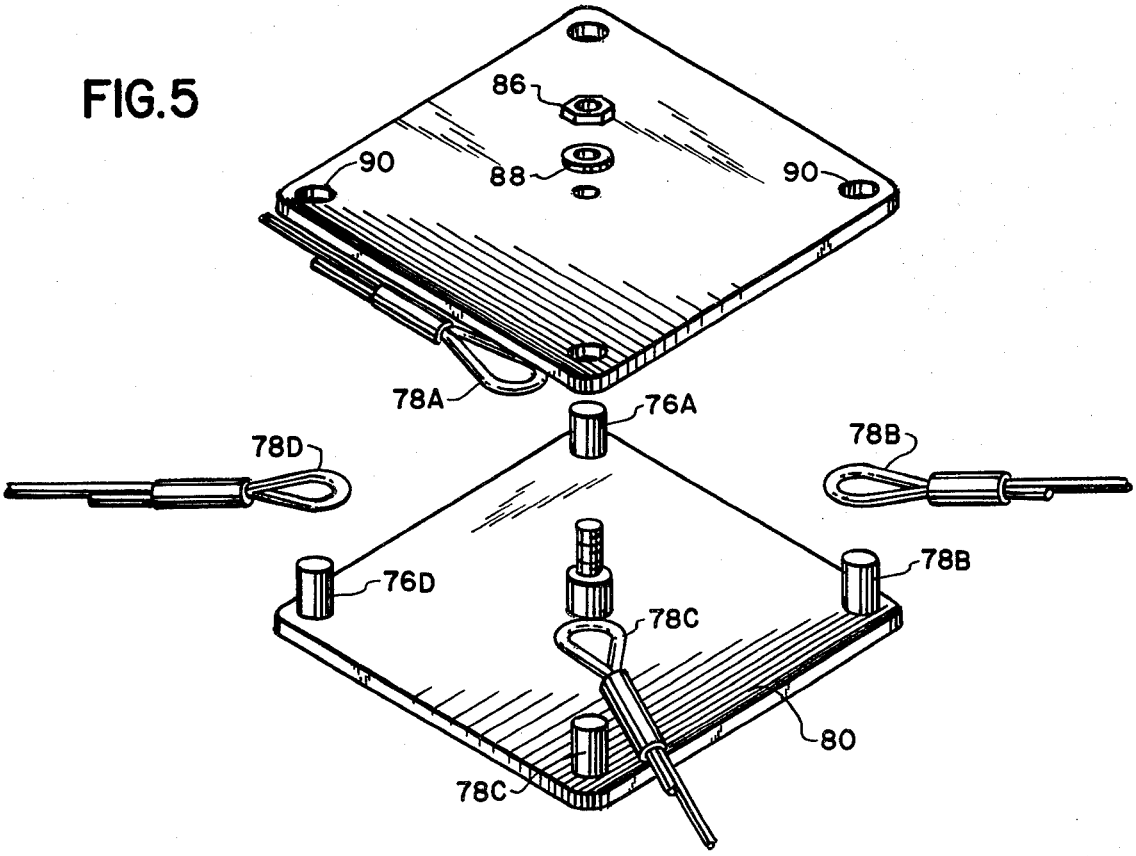
FIG. 5 illustrates a cable connector clamp for securing together the ends of up to four separate cables, and particularly intended for use at intersections between sections of the cabling system.

FIG. 5 is a cable connector clamp which is designed to provide four connecting posts 76A, B, C, and D for interconnecting up to four separate cable ends 78A, B, C, and D. The connector includes a bottom plate 80, of which the posts 76A, B, C, and D, are a part, and a top plate 82. The top plate is securely fastened to the bottom plate by means of a central stud post 84 and a nut and lock washer 86 and 88. The dimension of the post 84 from the shoulder shown in the drawing at 85 to the surface of plate 80 is preferably shorter than the posts 76A–76D, and openings are provided at the corners of the top plate 82, as indicated at 90, so that the tops of the posts 76A–76D are threaded through the openings 90 when the top plate 82 is in the clamped position so as to thereby securely hold all of the cable ends tightly within the connector clamp.

Figure 6:
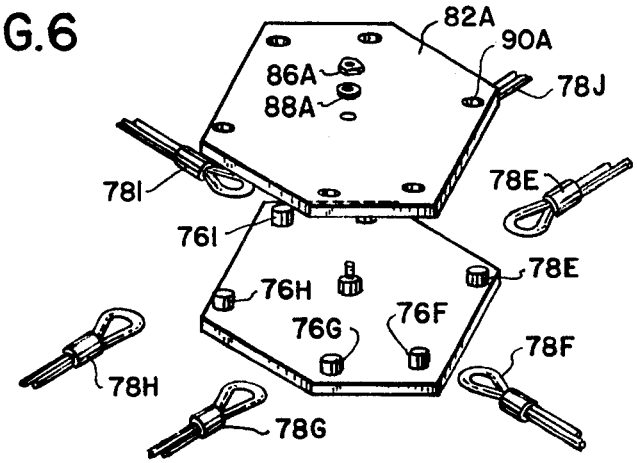
FIG. 6 illustrates another cable connector clamp which is capable of clamping and interconnecting up to six cable ends.

The cable connector clamp of FIG. 6 is similar in structure and function to that of FIG. 5, except that it is hexagonal in form, rather than square, and provides for the interconnection of up to six different cables 78E–78J on six different pins 76E–76J.

FIG. 7 provides a cable connector clamp which is also very similar to that of FIGS. 5 and 6, except that it provides for the interconnection of up to 10 cable ends and employs circular plates 80B and 82B. In the embodiment of FIG. 7, there is another difference. Each of the studs 94 to which the cable ends are attached includes screw threads, and all or most of these studs are fastened with threaded nuts when the top plate 82B is assembled to the bottom plate 80B, with the cable ends in place, to lock the two plates together securely.

It will be understood that access doors and equipment openings must be provided in the building illustrated in FIG. 1. These openings require interruptions in the latticework of cables with suitable frame members which may be carried out in the usual manner.

While this invention has been shown and described in connection with particular preferred embodiments, various alterations and modifications will occur to those skilled in the art. Accordingly, the following claims are intended to define the valid scope of this invention over the prior art, and to cover all changes and modifications falling within the true spirit and valid scope of this invention.

I claim:

1. A cabling system for reinforcement of an inflatable building structure comprising a latticework of crisscrossed cables arranged to extend over the entire building with substantially all of the cables which meet a lower peripheral edge of the structure being arranged diagonally at a uniform angle of substantially less than ninety degrees to that edge and with substantially all of said cables which meet a lower peripheral edge being paired with the meeting an opposite diagonally extending cable at said peripheral edge, the members of each of said pairs of diagonally opposite extending cables being formed from one continuous cable extending down on one diagonal to the edge and turning back up on the other diagonal, anchoring means to hold said continuous cable at the turn between diagonals, said anchoring means comprising a sheave arranged to permit an adjustment in length between the associated diagonal cables wherein one diagonal cable becomes longer and the other diagonal cable becomes shorter.

2. A system as claimed in claim 1 wherein said anchoring means sheave is freely rotatable.

3. A system as claimed in claim 2 wherein said rotatable sheave is positioned and arranged to rotate upon an axis substantially perpendicular to a plane defined by the latticework of cables in the vicinity of the sheave when the inflatable building structure is inflated.

4. A system as claimed in claim 1, or claim 2, or claim 3, wherein said uniform angle of substantially less than ninety degrees is in the neighborhood of sixty degrees.

5. A system as claimed in claim 1 wherein the minimum diameter of said sheave is in the neighborhood of at least nine times the diameter of the cable.

6. A system as claimed in claim 3 wherein said anchoring means further comprises a support bracket for said sheave consisting of an L-section channel arranged to be anchored to a base structure for the inflatable building with said sheave being attached to an upstanding leg of said L-channel and with the other side of said L-channel being arranged to be attached to the building base structure.

7. A system as claimed in claim 6 wherein said sheave is mounted by means of an axle upon the side of the upstanding leg of said L-section support bracket at which the base leg of said support bracket is attached, and wherein there is provided a locking plate mounted upon said sheave axle at the outside of said sheave and having a slotted center opening to permit the raising and lowering of said locking plate to permit the insertion of the cable onto the sheave when the locking plate is raised and to lock the cable upon the sheave when the locking plate is lowered, the locking plate being arranged to be lowered into near proximity to said base leg of said sheave bracket, said sheave axle comprising a threaded bold fastener which is operable to tighten said locking plate in the locked position.

8. A system as claimed in claim 1 wherein said latticework of crisscrossed cables is constructed in sections with substantially all cable ends terminating at cable connector clamps at the adjoining edges of adjacent sections.

9. A system as claimed in claim 8 wherein the cable lattice sections for covering the ends of the inflatable building structure are formed with cables which are not parallel with the cables in the other sections.

10. A system as claimed in claim 1 or in claim 2 or in claim 3 wherein all intersecting cables are secured together at all intersections.

* * * * *

UNITED STATES PATENT AND TRADEMARK OFFICE

CERTIFICATE OF CORRECTION

PATENT NO. : 4,478,012

DATED : October 23, 1984

INVENTOR(S) : Donato M. Fraioli

It is certified that error appears in the above-identified patent and that said Letters Patent are hereby corrected as shown below:

Column 5, line 39 "the meeting" should read --and meeting--.

Signed and Sealed this

Second Day of July 1985

[SEAL]

*Attest:*

DONALD J. QUIGG

*Attesting Officer*

*Acting Commissioner of Patents and Trademarks*